United States Patent [19]

Hubert

[11] Patent Number: 4,554,919

[45] Date of Patent: Nov. 26, 1985

[54] MUSICAL PACIFIER

[75] Inventor: Claudette Hubert, St-Bruno, Canada

[73] Assignee: CX Packaging Inc., Ste-Julie, Canada

[21] Appl. No.: 677,993

[22] Filed: Dec. 4, 1984

[51] Int. Cl.[4] ..... A61J 17/00

[52] U.S. Cl. ..... 128/360; 128/359; D24/45

[58] Field of Search ..... 128/359, 360; D24/45, D24/46, 47

[56] References Cited

U.S. PATENT DOCUMENTS

| | | | |
|---|---|---|---|
| D. 189,880 | 3/1961 | Blake | D24/47 |
| D. 190,238 | 5/1961 | Blake | D24/47 |
| D. 221,912 | 9/1971 | Day | D24/45 |
| D. 268,651 | 4/1983 | Doyle | D24/45 |
| D. 273,991 | 5/1984 | Moore | D24/45 |
| 552,399 | 12/1895 | Smith | 128/359 |
| 2,462,786 | 2/1949 | Steckler | 128/360 |
| 2,717,473 | 9/1955 | Moore | 128/359 |
| 3,221,444 | 12/1965 | Hettinga | 128/359 |
| 3,283,758 | 11/1966 | Killebrew | 128/359 |
| 3,913,402 | 10/1975 | Doyle | 128/360 |
| 3,935,405 | 1/1976 | Auer | 128/359 |
| 4,493,324 | 1/1985 | Johnston | 128/360 |

FOREIGN PATENT DOCUMENTS

| | | | |
|---|---|---|---|
| 756792 | 9/1956 | United Kingdom | 128/360 |
| 2057274 | 4/1981 | United Kingdom | 128/359 |

*Primary Examiner*—Gene Mancene
*Assistant Examiner*—James Hakomaki

[57] ABSTRACT

A musical pacifier comprising a mouthpiece having a single portion, a casing is secured to the mouthpiece for housing an electronic programmed circuit capable of generating signals to produce a musical tune. A sound generator is associated with the circuit to audibly reproduce the signals. A switch is provided to actuate the electronic programmed circuit.

10 Claims, 7 Drawing Figures

10
11
12
13
15
18
33

13
21
22
44
46
20
42
43
41
32
31
38
39
37

48
13'
49
50
50

40
18
36
34
35
16
19
17
15

Fig. 4
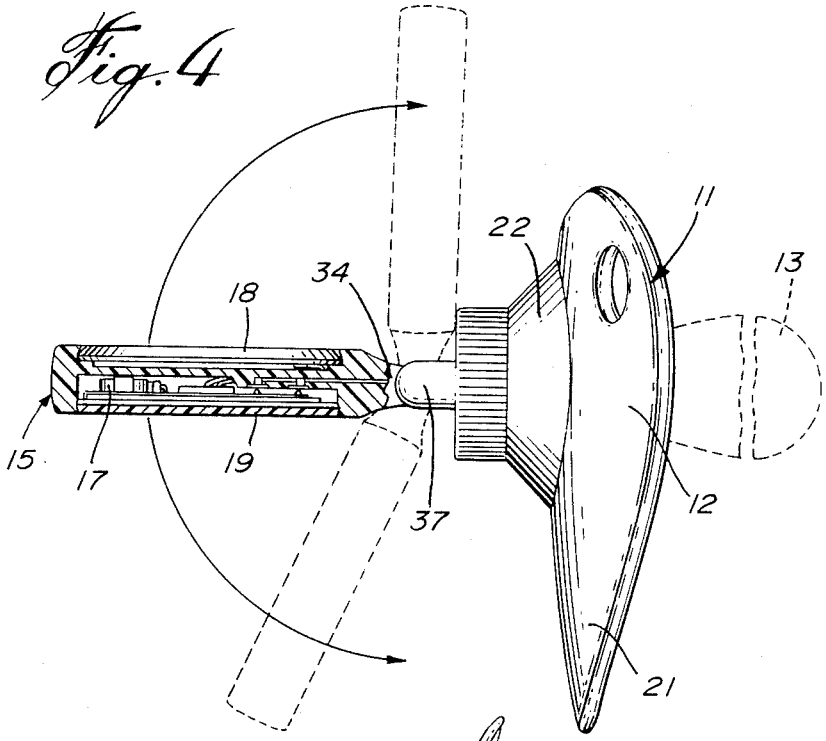
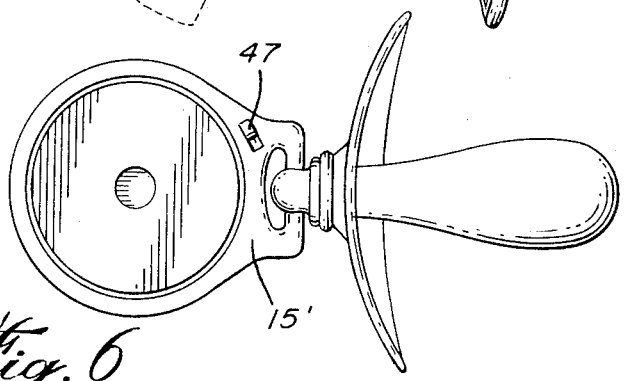
Fig. 6
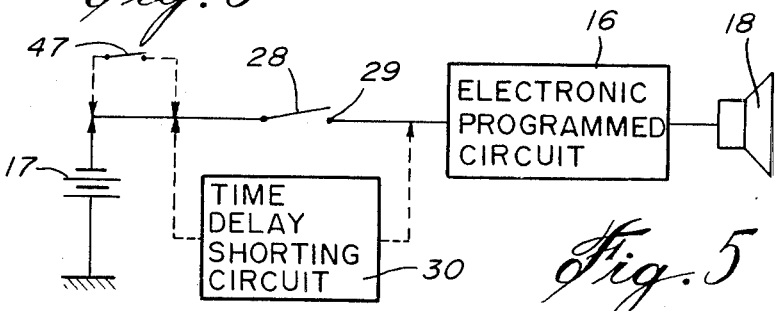
Fig. 5

MUSICAL PACIFIER

BACKGROUND OF THE INVENTION (a) Field of the Invention

The present invention relates to a musical pacifier having a casing detachably secured to the mouthguard of the pacifier on the opposite side of the nipple element and which casing houses an electronic programmed circuit which is switchable to produce a musical tune.

(b) Description of Prior Art

Various types of amusement devices have been provided whereby to occupy an infant. Such known devices comprise various types of noise makers such as, hand held structures which produce sounds when shaken or compressible toys which generate sounds when air is compressed out of the toy or admitted into the toy. These devices have the advantages of keeping an infant amused for long periods of time, when left alone.

SUMMARY OF THE INVENTION

It is a feature of the present invention to provide a novel noise maker for infants and this is achieved by a musical pacifier wherein a casing is detachably secured to the mouth-guard of the pacifier and houses an electronic programmed circuit which when switched "on" will produce a musical tune.

Another feature of the present invention is to provide a musical pacifier wherein the pacifier is switched on by an infant by slightly compressing the nipple portion of the pacifier.

Another feature of the present invention is to provide a musical pacifier wherein the casing housing the electronic programmed circuit is detachably secured to the mouth-guard of the pacifier.

Another feature of the present invention is to provide a musical pacifier having switch means on a housing thereof to switch an electronic programmed circuit, capable of generating signals to produce a musical tune, to an "on" or an "off" state.

Another feature of the present invention is to provide a musical pacifier having a casing housing an electronic programmed circuit which is detachably secured by novel connecting means to permit the nipple portion to be sterilized in boiling water while preventing the circuit and its connections and contacts exposed to the hot water.

According to the above features, from a broad aspect, the present invention provides a musical pacifier comprising a mouthpiece having a nipple portion. A casing is secured to the mouthpiece and houses an electronic programmed circuit capable of generating signals to produce a musical tune. Sound generating means is associated with the circuit to audibly reproduce the signals. Switch means are provided to actuate the electronic programmed circuit.

BRIEF DESCRIPTION OF THE DRAWINGS

A preferred embodiment of the present invention will now be described with reference to the examples thereof as illustrated in the accompanying drawings, in which:

FIG. 4 is a partly fragmented side view of the musical pacifier;

FIG. 5 is a block diagram of the electronic programmed circuit;

FIG. 6 is a side view of another example of the construction of the musical pacifier.

DESCRIPTION OF PREFERRED EMBODIMENTS

Figures 1, 2, 7:
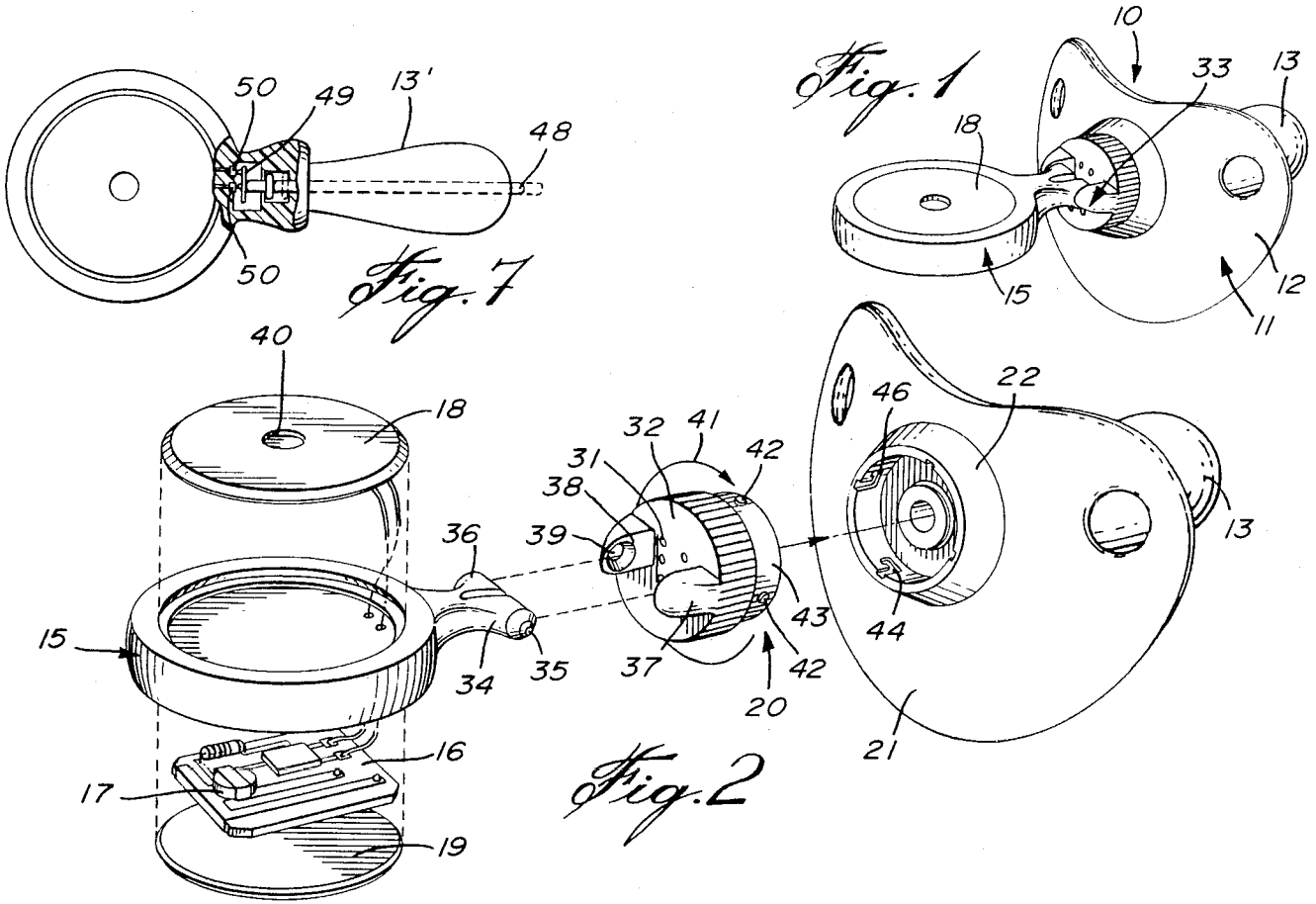
FIG. 1 is a perspective view of the musical pacifier of the present invention.
FIG. 2 is an exploded view of FIG. 1.
FIG. 7 is a partly fragmented side view showing another example of the musical pacifier but for use with dolls.

Referring to the drawings and more particularly to FIGS. 1 and 2, there is shown generally at 10 the musical pacifier of the present invention. The pacifier comprises essentially a mouthpiece 11 consisting of a mouthguard 12 to which a nipple element 13 is secured and extends from a front side 14 thereof. A detachable casing 15 which also constitutes a hand holdable member, is detachably secured to the rear side of the mouthguard. The casing 15 houses an electronic programmed circuit 16 which is mounted on a circuit board and which is fed by a power cell battery 7 of the type commonly found in wrist watches having a very low voltage and amperage capacity. A sound generating means, herein a speaker element 18, is also secured to the casing 15 on one of its faces whereby to audibly reproduce the programmed signals generated by the circuit 16. A cover 19 retains the circuit 16 captive within the casing 15. A speaker element, such as at 18, could also be provided instead of the cover 19 whereby to generate sounds from both sides of the casing 15.

Figure 3:
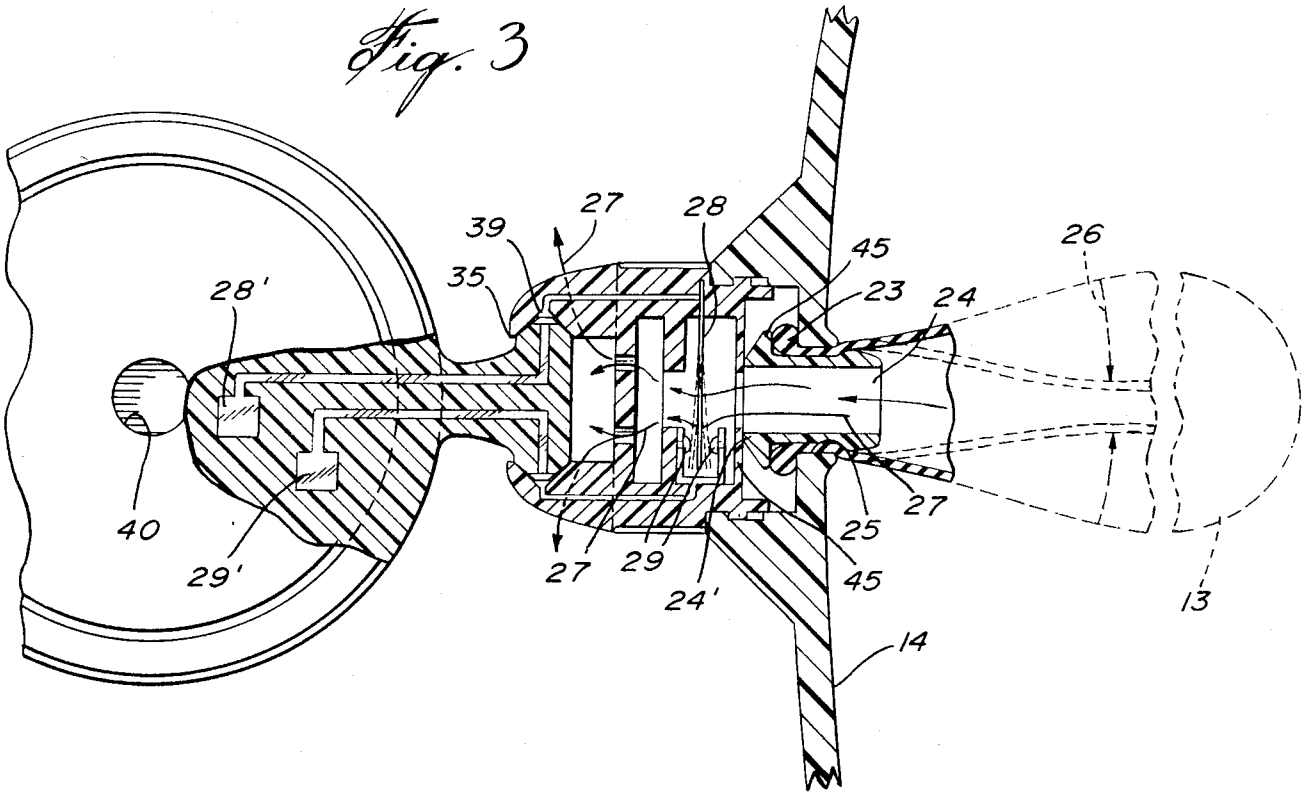
FIG. 3 is a partly fragmented enlarged section view of the pacifier as shown in FIGS. 1 and 2.

In order to activate the electronic programmed circuit switch means is provided. Various forms of switch means will be described herein. With particular reference to FIG. 3, there is shown a preferred, although not exclusive, form of the switch means which is housed within a switch housing 20 which is detachably secured to a female coupler 22 secured to the rear face 21 of the mouth-guard. The nipple element 13 also has a hollow securable open end 23 which is secured in an opening 25 in the mouth-guard 12 and extends within the female coupler 22. A hollow retention plug 24 fits securely in the open end 23 and tightly within an opening 25 to immovably retain the securable end 23 captive within the opening 25. Thus, the nipple can be collapsed in the direction of arrows 26 by releasing the air therein through the hollow plug 24 and can be expanded by admitting air through that hollow space.

The switch housing 20 has a passage defined therethrough whereby to evacuate or admit air along the path, as shown by arrows 27, from or to the inside of the nipple element 13. In the path of this air flow, there is mounted a movable switch arm contact 28 secured at one end and opposed stationary contact points 29 spaced on both sides of the free end of the movable contact 28. Thus, as air is expelled from the nipple element 13 or admitted to the nipple element 13, it will displace the contact 28 to touch the stationary contact points 29, thus effecting a switch closure.

The contact points 29 may also have weak magnetic properties whereby to retain the free end portion of the movable contact 28 engaged for a short predetermined time period to maintain the circuit 16 activated. The contact arm 28 is formed as a flat metal strip.

As shown in FIG. 5, when the switch contact 28 effects a closure, the power cell battery 17 is connected to the electronic programmed circuit 16 to activate the circuit to produce signals which are generated by the speaker element 18. Thus, it can be seen that the electronic programmed circuit is switched "on" and "off" by the infant compressing and decompressing the nipple element 13 which is the natural action that an infant performs when sucking on the nipple element. Thus, the child becomes conscious that he activates music sounds and continues to suck or bite on the nipple element to produce these sounds.

A time delay shorting circuit 30 may also be connected across the switch contact 28 whereby once a single switch closure is made the switch is automatically shorted out and the dry cell battery 17 activates the electronic programmed circuit for a predetermined period of time. This predetermined period of time is calculated to permit the programmed circuit to produce signals of a complete musical tune. After the predetermined time delay, the shorting circuit deactivates itself. However, if the switch element is again closed, it will again activate itself and again cause the programmed circuit to generate a complete musical tune.

Referring again to FIG. 2, the construction of the switch housing 20 will be described. The housing 20 is provided with holes 31 extending through a rear wall 32 thereof for the air to move out and into the switch housing. Also, as herein shown, the casing 15 is detachably securable to the switch housing 20 through a pivot connection 33. The connection 33 comprises a T-bar connector 34 which is integrally formed with the casing 15 and has electrical contact points 35 in each end of its transverse connecting arm 36. The transverse arm 36 is retained between a pair of opposed shoulders 37, each provided with an inner facing cavity 38 having electrical contact points 39 therein whereby to complete the electrical connection between the switch contact arm 8 and the stationary contacts 29 from the battery 17 to the circuit 16. These circuit contacts are shown more clearly in FIG. 3 where there is shown a printed circuit wire leading to terminal points 28' and 29'. The speaker element 18 is provided with a central opening 40 through which the sound emanates.

When it is necessary to sterilize the mouthpiece 11, the switch housing 20 and the casing 15 are disconnected from the mouth-guard 12 by pushing the switch housing 20 inwardly into the mouth-guard and rotating the switch housing 20 into the direction of arrow 41 whereby to disconnect the lock mechanism which is infant-proof. The lock mechanism is comprised of a plurality, at least two, spaced apart posts 42 extending outwardly on a cylindrical end portion 43 or male coupler of the switch housing 20. A plurality of coinciding, at least two spaced apart channels 44 are disposed on the inner cylindrical wall of the female coupler 22 and receive an associated one of the posts 42 therein as the cylindrical end portion 43 is pushed into the cylindrical female coupler 22. The outer face of the cylindrical end portion 43 is provided with a thin wall flange portion 45 which flexes against the pointed outer end 24' of the hollow plug 24 to provide flexing of the flange portion 45 to constitute spring means whereby to urge the posts 42 into engagement in a transverse locking end portion 46 of the channels 44 to provide the infant-proof lock to prevent the switch housing and casing from being detached by an infant. Thus, it can be seen that by pushing the casing 15 towards the mouth-guard 12 that the flexible flange 45 will bend permitting the post 42 to move out of the securable ends 46 and then by rotating the switch housing in the direction of arrow 41, it is detached from the mouth-guard. No electrical or metal post is left attached to the mouth-guard permitting it to be sterilized in boiling water without damage to the electrical paths. Also, this connection permits a standard ring member (not shown) to be connected to the mouth-guard to connect it to an ordinary pacifier.

As shown in FIG. 4, the hinge connection 33 permits the casing 15 to be displaced over an arc of 180 degrees to provide a safety feature so that if the infant falls asleep with the pacifier in his mouth and turns his face onto a pillow or mattress, the casing will bend and not offer resistance against this movement and hurt the child's mouth.

Referring now to FIG. 6, there is shown a further example of the preferred embodiment of the present invention wherein the casing 15' is constructed differently but houses the same electronic programmed circuit 16 and speaker 18. The switch means is herein provided by conventional mechanical toggle switch 47 mounted on a face of the casing 15' and actuatable by an adult whereby to switch on the programmed circuit to generate music. When it is necessary to switch off the music, usually after the infant is asleep, the adult simply switches the switch 47 to its "off" position. The connection between the casing and the mouth-guard is the same as with an ordinary ring connection and the casing is also displaceable about the connector 33'. The switch 47 may also be permanently provided on the casing 15 of FIG. 1, whereby to permanently switch out the dry cell battery 17 to deactivate the automatically activatable air current switch.

Referring now to FIG. 7, there is shown another example of the preferred embodiment of the present invention. The musical pacifier as herein shown is miniaturized for use with toy dolls. It is comprised essentially of an actuating pin 48 which is biased outwardly of the mouthpiece 12 by the nipple element 13 (or any other suitable means) which is positioned about the pin to provide an outward spring force against the pin which protrudes slightly outwardly of the nipple element 13'. By positioning the pin 48 in the small hole usually provided in the mouth of a doll and pushing on it, a contact element 49 at the inner end of the pin 48 bridges contact points 50 and causes the dry cell 17 to be connected to the electronic programmed circuit 16. When the pacifier is removed from the mouth of the doll (not shown), the pin 48 is simply pulled out by the fingers or will be pushed out automatically by the spring force of the nipple element 13 to cause an open circuit between the switch contact 50. The electronic programmed circuit is then switched off.

It is within the ambit of the present invention to cover any obvious modifications of the examples of the preferred embodiment described herein, provided such modifications fall within the scope of the appended claims.

I claim:

1. A musical pacifier comprising a mouthpiece having a nipple portion, a casing secured to said mouthpiece and housing an electronic programmed circuit capable of generating signals to produce a programmed sound, sound generating means associated with said circuit to audibly reproduce said signals, and switch means to actuate said circuit.

2. A musical pacifier as claimed in claim 1 wherein said mouthpiece has a mouth-guard to which said nipple element is secured, said housing being connected to said mouth-guard on a side thereof opposite to said nipple element.

3. A musical pacifier as claimed in claim 1 or 2 wherein said switch means is a mechanical switch secured to said casing and actuatable from an outside wall thereof whereby to switch said electronic programmed circuit to an "on" or "off" state.

4. A musical pacifier as claimed in claim 2 wherein said switch means is a switch contact element actuated by an air current which is generated by a displacement of air in a hollow space within said nipple element.

5. A musical pacifier as claimed in claim 4 wherein said nipple element has a securable open end which is secured in a bore in said mouth-guard by a hollow connector, said connector having passage means therein to form an air passage means therein to form an air passage from said hollow space within said nipple element to a space in which said switch contact is located.

6. A musical pacifier as claimed in claim 5 wherein said switch contact comprises a stationary contact and a displaceable contact, said displaceable contact having a free end portion extending into said space where there is created an air current by said nipple element, said air current causing said free end portion to flex and contact said stationary contact to effect a switch closure.

7. A musical pacifier as claimed in claim 6 wherein evacuation ports are communicated with said air passage to evacuate air from said passage when said hollow nipple element is collapsed and to admit air by suction created by said nipple element when restoring its initial shape after being compressed.

8. A musical pacifier as claimed in claim 4 wherein said housing is removably secured to said mouth-guard through a lock mechanism which is infant-proof and which houses said switch means, said casing and said lock mechanism being interconnected through a hinge joint, said casing being removable from said lock mechanism.

9. A musical pacifier as claimed in claim 8 wherein said lock mechanism comprises two cylindrical parts, one of said parts having at least two spaced apart posts extending diametrically outward of a cylindrical outer surface thereof, the other of said parts having at least two spaced apart channels corresponding to the spacing of said posts and disposed in an inner surface thereof to permit passage of said posts therein and to overlap a portion of said outer surface of said one part when advanced thereover, said channels having a locking end to receive an associated one of said posts therein against the pressure of spring means when said other part is rotated in a predetermined direction, said posts being retained at said locking end by said pressure.

10. A musical pacifier as claimed in claim 8 wherein said articulated joint is provided with electrical connectors.

* * * * *